United States Patent [19]

Davison et al.

[11] Patent Number: 4,567,826

[45] Date of Patent: Feb. 4, 1986

[54] LABEL MARKER FOR A CONFINED AREA

[75] Inventors: Charles F. Davison, Brookfield; Robert Myles, Chicago, both of Ill.

[73] Assignee: Norwood Marking & Equipment Co., Inc., Downers Grove, Ill.

[21] Appl. No.: 636,926

[22] Filed: Aug. 2, 1984

[51] Int. Cl.[4] ..... B41F 1/06; B41K 1/42

[52] U.S. Cl. ..... 101/318; 101/334

[58] Field of Search ..... 101/334, 104, 105, 290, 101/301, 310, 318, 324

[56] References Cited

U.S. PATENT DOCUMENTS

| | | | |
|---|---|---|---|
| 191,265 | 5/1877 | Tarbox | 101/104 |
| 702,753 | 6/1902 | Watkins | 101/301 |
| 963,916 | 7/1910 | Meier | 101/290 |
| 1,377,208 | 5/1921 | Levine | 101/301 |
| 1,710,633 | 4/1929 | Marks | 101/105 |
| 2,194,374 | 3/1940 | Wunsch | 92/121 X |
| 2,829,594 | 4/1958 | Goc | 101/104 |
| 4,331,077 | 5/1982 | Sokolovsky | 101/334 X |

FOREIGN PATENT DOCUMENTS

| | | | |
|---|---|---|---|
| 377693 | 6/1923 | Fed. Rep. of Germany | 101/334 |

*Primary Examiner*—Clifford D. Crowder

*Attorney, Agent, or Firm*—Hill, Van Santen, Steadman & Simpson

[57] ABSTRACT

A label marker for a confined area, such as between a stack of labels to be imprinted, and ink pad, and a closely disposed conveyor for articles to which the labels are to be affixed, has a print head which reciprocates between and ink pad and the exposed label in the stack of labels. The print head is mounted at the end of a shaft, above which is disposed a combination rotator and reciprocator for causing the shaft and the print head to execute a combined rotary and reciprocating motion between the ink pad and the label stack. In a sequence beginning with the print head disposed against the ink pad, the combination reciprocator and rotator causes the ink pad to move linearly away from the ink pad, execute a rotation of 180°, and again execute a linear motion toward the exposed label for imprinting thereon. After imprinting, a print head moves linearly away from the now-imprinted label, executes a 180° rotation in the opposite direction, and again moves linearly toward the ink pad for re-inking.

18 Claims, 12 Drawing Figures

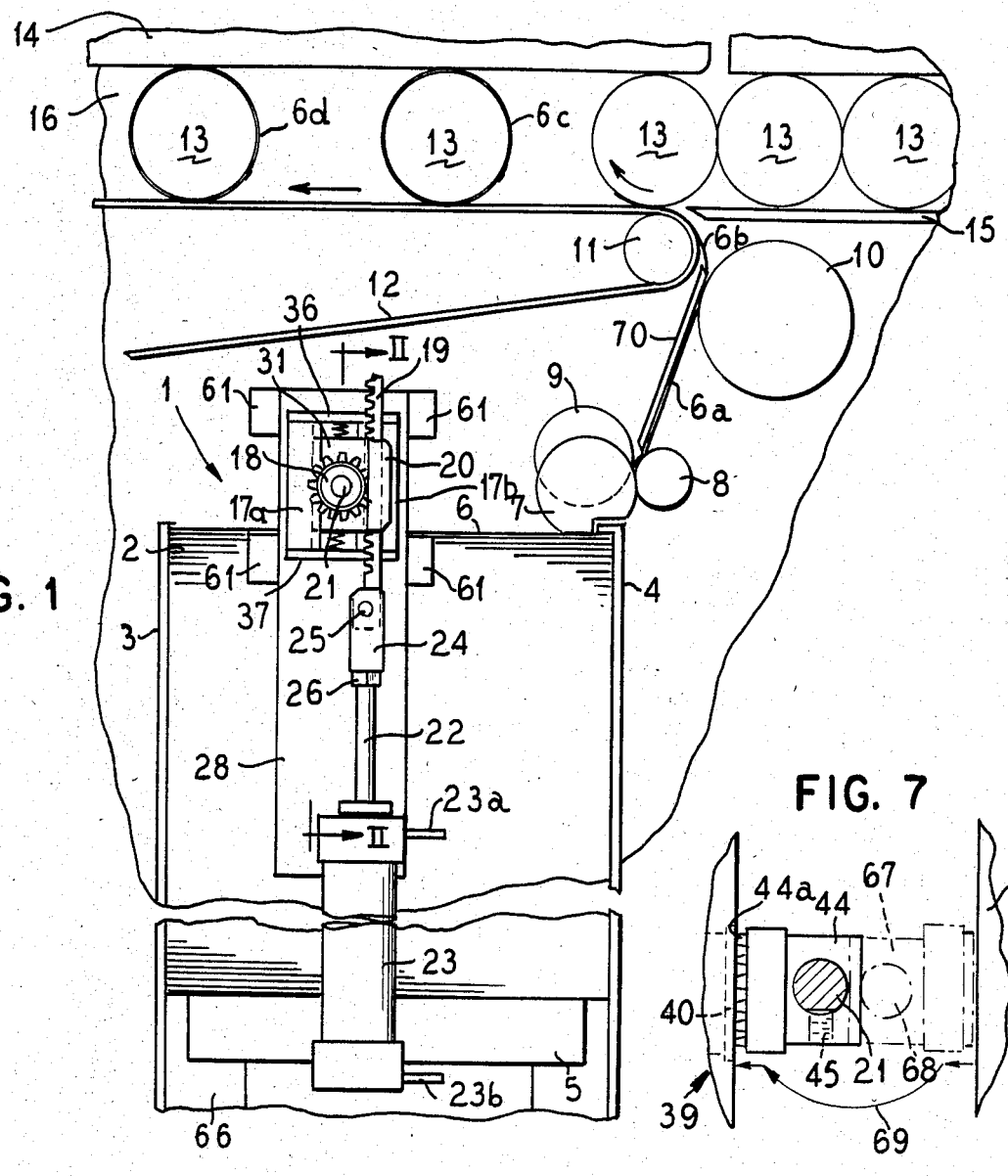
FIG. 1
FIG. 7
FIG. 6
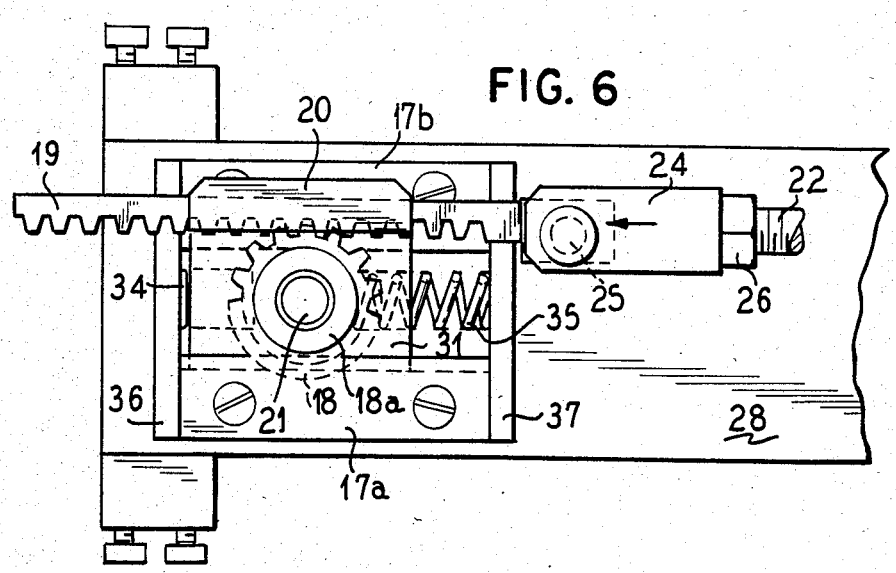

FIG. 2
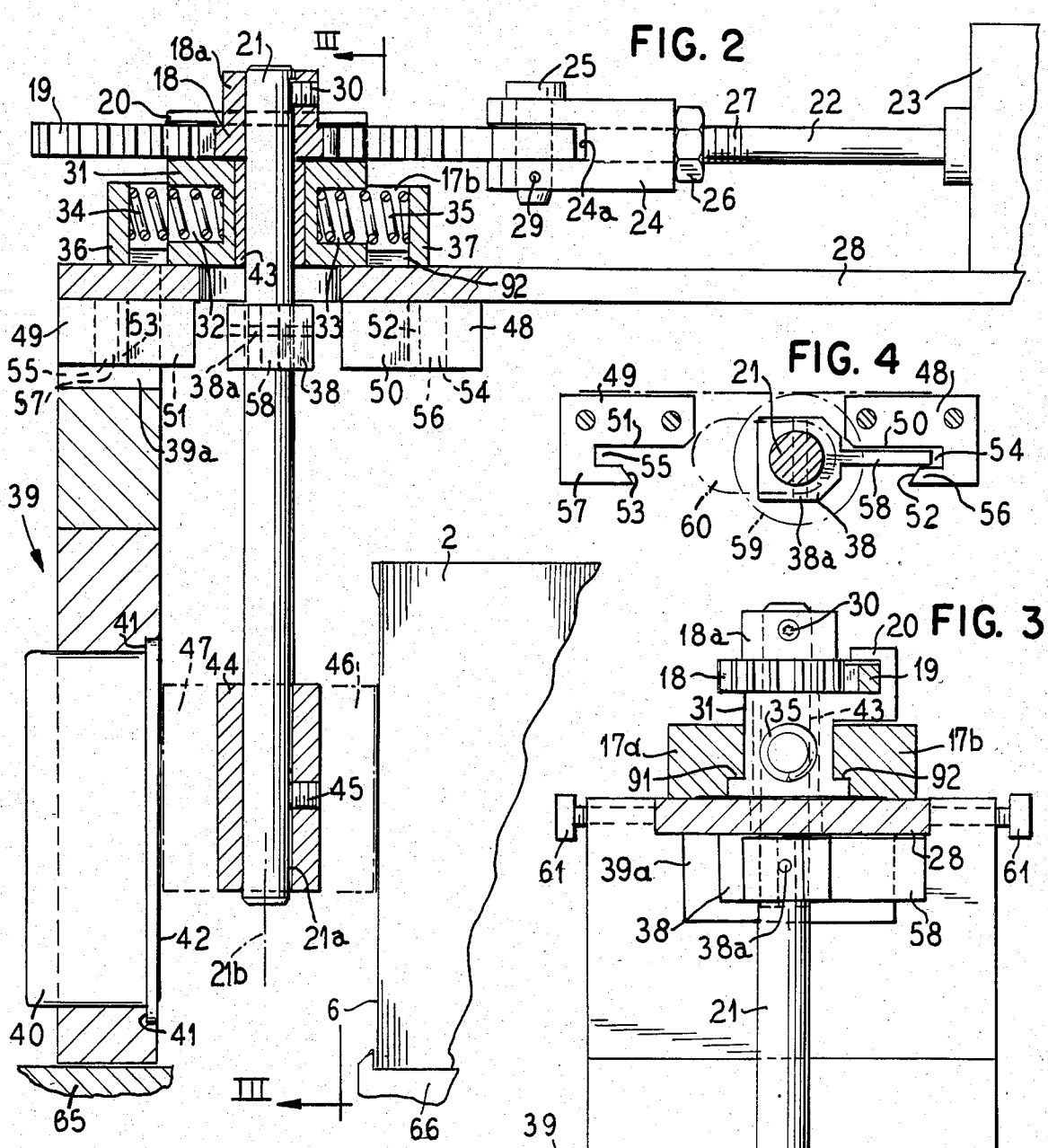
FIG. 4
FIG. 3
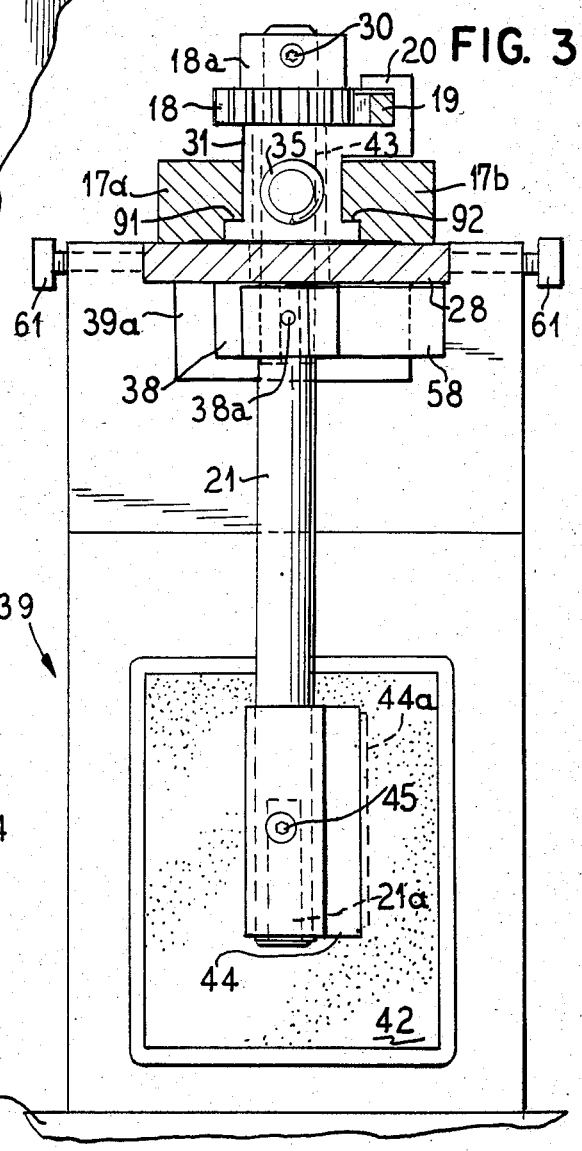
FIG. 5
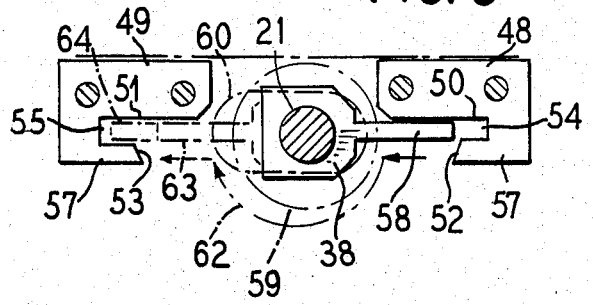

FIG. 8
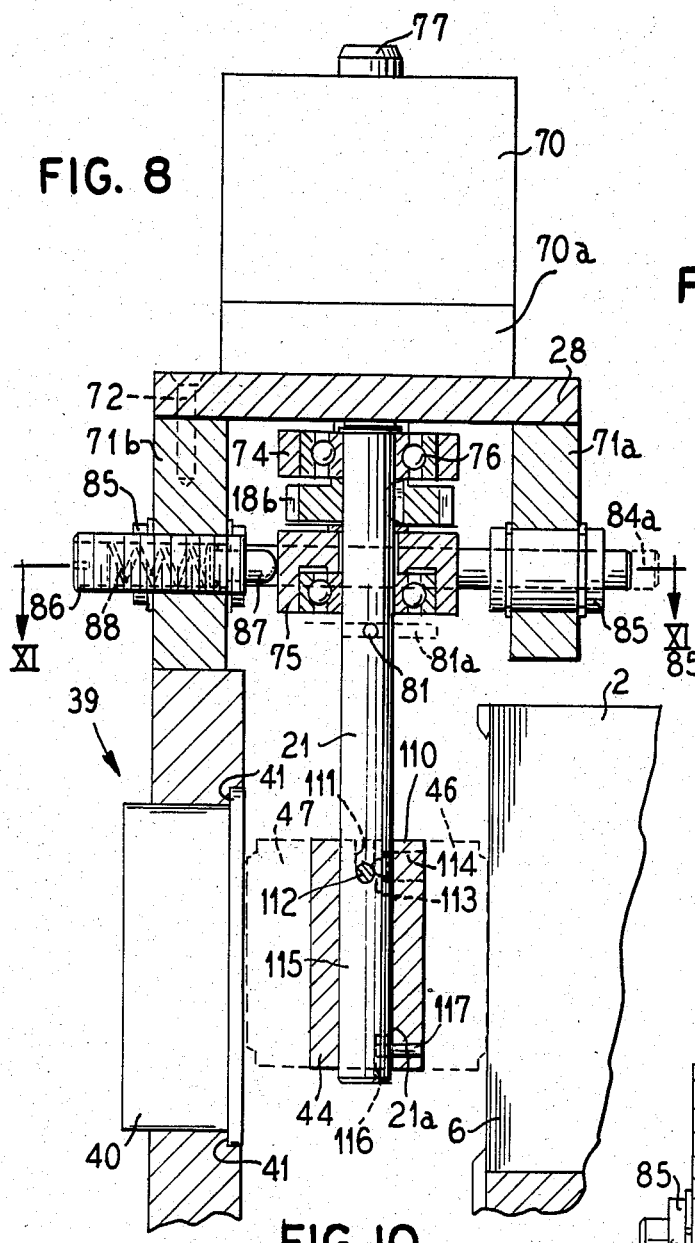
FIG. 9
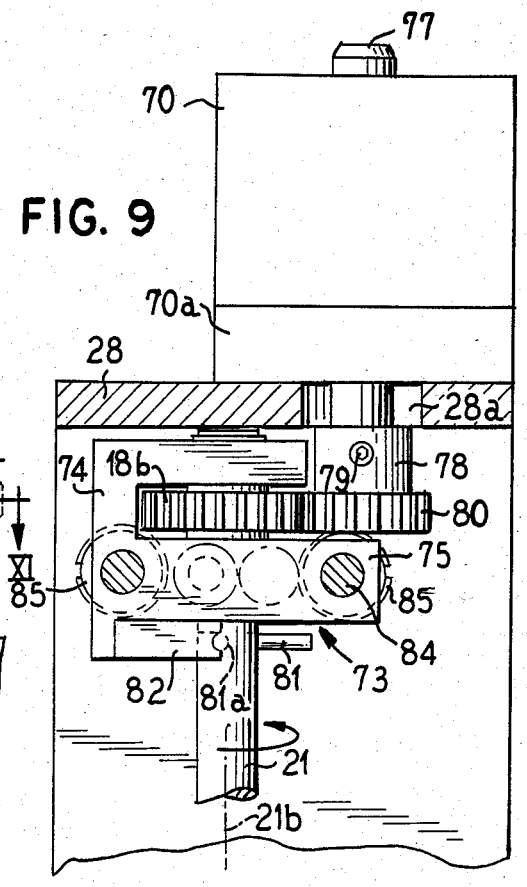
FIG. 10
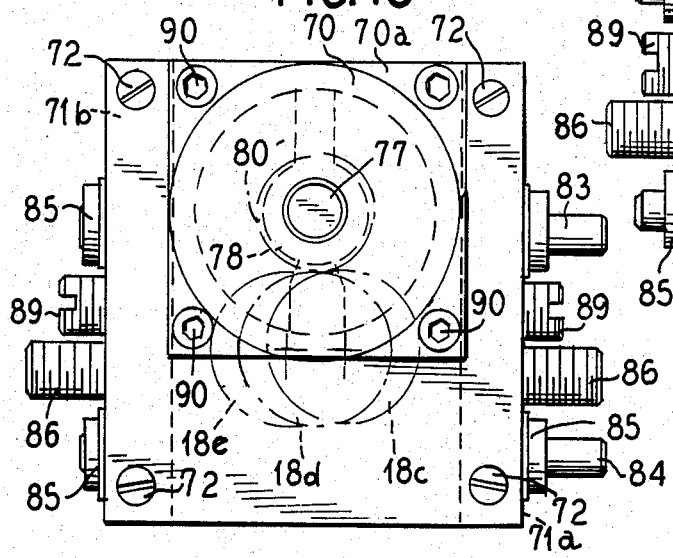
FIG. 11
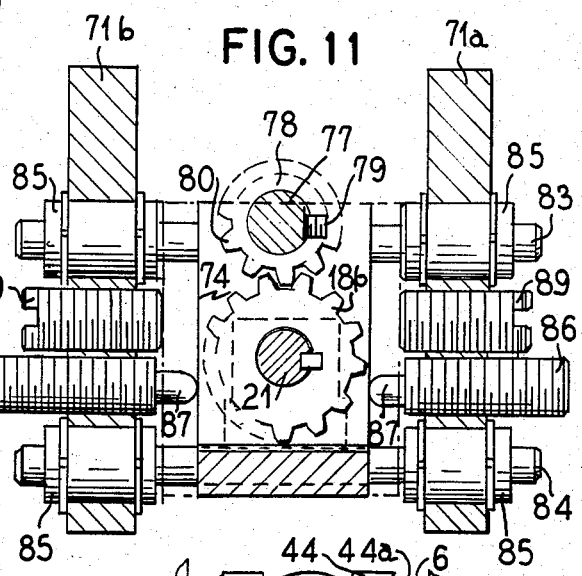
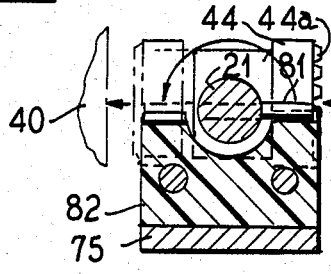
FIG. 12

LABEL MARKER FOR A CONFINED AREA

BACKGROUND OF THE INVENTION

1. Field of the Invention

The present invention relates to label markers, and in particular, to a label marker which can be utilized in a confined area.

2. Description of the Prior Art

Label markers are known in the art for rapidly imprinting a legend or other information on a label before the label is affixed to an article. A problem in the manufacture and design of such markers is that frequently the stack of labels to be imprinted is disposed very close to the conveyor means which conveys the articles to which the imprinted labels are to be affixed. This leaves only a confined area within which the marker may operate. Such confinement may be due to the desire in designing a new conveyor system to minimize the transfer distance between the label after imprinting and the articles to which the label is to be affixed, or may be the result of space limitations present in existing machinery.

In most cases, the print head carrying the characters to be imprinted on the label must be re-inked after each imprinting. This requires constant successive transfer of the print head between an ink supply, such as an ink pad, and the next label to be imprinted. In order to avoid excessive wear, it is preferable that the print head approach and recede from the ink pad for reinking in a substantially linear direction, and it is also necessary, in order to obtain a clear imprintation without smudging, that the print head rapidly and linearly approach and recede from the label to be imprinted.

SUMMARY OF THE INVENTION

It is an object of the present invention to provide a label marker for use in a confined area which has a printing head reciprocating between an ink pad and a label to be imprinted which approaches and recedes from both the ink pad and the label in a substantially linear direction.

It is a further object of the present invention to provide such a label marker which can operate extremely rapidly while achieving a clear, unsmudged imprintation on each label with re-inking between each imprinting.

The above objects are inventively achieved in a label marker having a print head carried at the end of a shaft, the opposite end of the shaft being connected to a combination reciprocator and rotator. The combination reciprocator and rotator causes the shaft and print head to execute a combined lateral and rotary motion between an ink pad and a stack of labels to be imprinted in rapid succession. After coming into contact with the ink pad for receiving a supply of ink therefrom, the reciprocator and rotator causes the print head to recede linearly from the ink pad in a direction toward the stack of labels to be imprinted, execute a 180° rotation to bring the characters on the print head adjacent to a label in the stack to be imprinted, and linearly rapidly move against the label to imprint the label. After contact with the now-printed label, the combination reciprocator and rotator causes the shaft and print head to move linearly away from the label, execute a 180° rotation in the opposite direction so that the characters on the print head are now adjacent the ink pad, and to move linearly into contact with the ink pad for re-inking.

In one embodiment, the combination rotator and reciprocator is a rack and pinion arrangement, and in another embodiment, is a rotary air actuator. In each embodiment, the shaft has a rotation limiting means thereof which abuts against a stop in each rotational direction of the shaft. After abutment against the stop, the shaft and print head no longer rotate, but are still linearly moved as the limiting means slides along the stop or moves with the stop.

In a further embodiment of the invention, the combination reciprocator and rotator is a rotary air actuator and a pair of rods slidably supported in bearings in a frame. The rods are connected to a mounting block in which the shaft which carries the print head is rotatably mounted. Although the rotary air actuator is stationary, the slidable mounting of the print head shaft permits sufficient lateral play to achieve the desired small lateral movement of the print head.

DESCRIPTION OF THE DRAWINGS

FIG. 1 is a plan view of a label marker for use in a confined area constructed in accordance with the principals of the present invention.

FIG. 2 is a sectional view of a portion of the label marker shown in FIG. 1 taken along line II—II.

FIG. 3 is a sectional view of the label marker shown in FIG. 2 taken along line III—III.

FIG. 4 is a plan view of the rotation limiting means in a first position for the label marker shown in FIG. 1.

FIG. 5 is a plan view of the rotation limiting means showing the sequence of movement thereof during operation of the label marker shown in FIG. 1.

FIG. 6 is an enlarged plan view of a first embodiment of a combination rotator and reciprocator.

FIG. 7 is a view of the print head as seen from below showing movement thereof during operation of the marker shown in FIG. 1.

FIG. 8 is a front view, partly in section, of a further embodiment of a label marker constructed in accordance with the principals of the present invention employing a rotary air actuator.

FIG. 9 is a side view of the label marker shown in FIG. 8.

FIG. 10 is a plan view of the label marker shown in FIG. 8.

FIG. 11 is a sectional view of the label marker shown in FIG. 8 taken along line XI—XI.

FIG. 12 is a view from below, partly in section, showing movement of the print head in the marker shown in FIG. 8 in accordance with the principals of the present invention.

DESCRIPTION OF THE PREFERRED EMBODIMENTS

A first embodiment for a label marker for use in a confined area constructed in accordance with the principals of the present invention is shown in FIG. 1, also showing the surrounding feed devices for labels to be imprinted and for articles to which the imprinted labels are to be attached. The label marker 1 is disposed above a stack 2 of labels to be imprinted. The stack 2 is laterally confined between guides 3 and 4 and is supported from beneath by a label support 66. The stack 2 is urged forward by a suitable bias means 5, of any type well known to those skilled in the art, which presents an exposed unprinted label 6 to the label marker 1 for imprinting. After the label marker 1 has imprinted the label 6, as described in detail below, the now-printed label is removed from the stack 2 by a vacuum roll 7 and is removed therefrom by oppositely rotating pinch rollers 8 and 9. The now-printed label, such as the label 6a, is moved along a gluing guide 70 past a gluing roller 10. Each printed and glued label, such as label 6b, is then transferred to a continuous belt 12 around a turning roller 11 and is moved into contact with an article 13, to which the label remains affixed by the glue. Such affixed labels are exemplified by 6c and 6d. The articles 13 move in a channel 16 defined at one side by a wall member 14 and at the opposite side by another wall member 15 and the belt 12. Movement of the belt 12 imparts a slight rotation to each article 13 as it moves by the label in the position of the label 6b, causing the label to be wiped onto the article 13.

As shown in detail in FIGS. 2, 3 and 6, the label marker 1 has a frame consisting of frame blocks 17a and 17b held in parallel spaced relation by frame walls 36 and 37. The space between the frame blocks 17a and 17b is occupied by a lower portion 31 of a mounting block. The mounting block also has a guide 20 for receiving the rack 19, and maintaining the teeth of the rack 19 in engagement with a pinion 18. The pinion 18 has a boss 18a for receiving a shaft 21 having a longest, or longitudinal, axis 21b, made co-rotational with the pinion 18 by a set screw 30. The shaft 21 extends through the lower portion 31 of the mounting block for rotation about its longitudinal axis 21b. As described in greater detail below, upon reciprocation of the rack 19, the entire mounting block, and the shaft 21 extending therethrough, are also reciprocated. The frame blocks 17a and 17b have respective recesses 91 and 92 which, in combination with a shelf 28 disposed beneath the box, form respective races for receiving opposed extension of the lower portion 31 of the mounting block. The mounting block is thus restrained and guided by the races as the lower portion 31 thereof is reciprocated between the frame block 17a and 17b.

The rack 19 is moved within the guide 20 by a piston shaft 22 having a piston head (not shown) movable within a cylinder 23. Opposite ends of the cylinder 23 are alternately pneumatically or hydraulically pressurized by ports 23a and 23b in a manner known to those skilled in the art to impart reciprocal motion to the piston shaft 22 and to the rack 19. The rack 19 is connected to the piston shaft 22 by a clevis 24 having a recess 24a therein receiving one end of the rack 19. The rack 19 is retained within the recess 24a by a pin 25 retained by a lock pin 29. Stroke adjustment of the piston shaft 22/rack 19 combination is achieved by threads 27 at one end of the piston shaft 22 received in the clevis 24. After suitable adjustment, the relative positions of the piston shaft 22 and the rack 19 are fixed by tightening a nut 26. The label marker 1 and the piston and cylinder arrangement are mounted on the shelf 28, which is in turn supported by suitable mounting means 61.

The lower portion 31 of the mounting block has two cavities 32 and 33 therein for respectively receiving coil springs 34 and 35. The coil springs 34 and 35 respectively abut the frame walls 36 and 37. The lower portion 31 has a bushing or suitable bearing means 43 for receiving the shaft 21.

The shaft 21 extends through the shelf 28 and has a print head 44 disposed at an opposite end thereof. The print head 44 has a set screw 45 tightenable against a flat keyway 21a in the shaft 21 to prevent rotation of the print head 44 with respect to the shaft 21. The print head 44 has characters 44a (shown in FIG. 3) thereon for imprinting a legend or other information on the exposed label 6 of the stack 2. For this purpose, the print head 44 is movable, as described in detail below, from a printing position 46 adjacent the label 6, to an inking position 47 adjacent an ink pad surface 42. The ink pad surface 42 is carried on an ink supply means 40 received in shoulders 41 of a supporting wall 39.

For limiting the rotational movement of the shaft 21, and the print head 44 carried thereon, and imparting linear movement to the print head 44, the shaft 21 has a rotation limiter held thereon by a lock pin 38a. The rotation limiter 38 has a flap 58. On either side of the shaft 21, and the rotation limiter 38, are disposed blocks 48 and 49. Each block 48 and 49 has a respective stop surface 50 or 51 disposed for abutting the flap 58 in positions which are rotationally substantially 180° apart. The blocks 48 and 49 further have respective recesses 54 and 55 formed by respective flanges 56 and 57. The flange 56 has a slanted end face 52, and the flange 57 has a slanted end face 53.

As the rack 19 is, for example, moved to the left in FIG. 2, the pinion 18 and the shaft 21 are caused to rotate and in turn the flap 58 rotates as indicated by the circle 59 (FIGS. 4 and 5) until it abuts the stop surface 51 at the position 63 shown in dashed lines in FIG. 5. Further rotation of the shaft 21, and the print head 44, is thus prevented, however, the rack 19 continues its leftward lateral movement. The flap 58 slides along the stop surface 51 within the recess 55 to the position 64, also shown in dashed lines. This causes the print head 44 to execute a short lateral stroke against the ink surface 42, shown in FIG. 2. This sequence is indicated by the arrow 62.

The opposed springs 34 and 35 impart resistance to linear movement of the mounting block, and thus impart resistance to linear movement of the pinion 18 and the shaft 21 as well, and additionally tend to urge centering of the mounting block and the pinion 18 and the shaft 21 between the frame walls 36 and 37. This resistance is sufficient to cause rotation of the pinion 18 to occur during linear movement of the rack 19. Thus upon initial movement of the rack 19 from either end position, the pinion 18 will first move linearly with the rack 19 because of the centering action of the springs 34 and 35. This will allow withdrawal of the flap 58 from the appropriate one of the recesses 54 and 55 so as to clear one of the flanges 56 or 57. Thereafter, as the spring 34 or 35 opposing that direction of linear movement resists such linear movement, the pinion 18 will undergo rotation until the flap 58 comes into contact with the stop surface 50 or 51 of the other of the recesses 54 or 55. Thereafter further movement of the rack 19 will again impart linear movement to the mounting block and the pinion 18 and the shaft 21.

The pneumatic or hydraulic supply to the cylinder 23 at this point causes the piston shaft 22 and the rack 19 to begin moving in the opposite direction, the initial portion of this opposite movement being accomodated by the spring 34. At a certain point in the opposite lateral movement, the flap 58 will begin to move out of the recess 55 and upon reaching the slanted end face 53 of the flange 57, the shaft 21 and the print head 44 will again begin rotation about the circle 59 to the solid-line position shown in FIG. 5 substantially 180° opposite to the dashed-line position. The shaft 21 and the print head 44 will simultaneously with this rotation also execute lateral movement, as indicated by the oblong curve 60.

The flap 58 will then assume the solid-line position shown in FIG. 5, abutting the stop surface 50. Further movement of the rack 19 to the right in FIG. 2 will cause the flap 58 to move into the recess 54 as shown in FIG. 4, and the coil spring 35 is compressed. As this point, the print head 44 is in the position 46 shown in FIG. 2 in brief contact with the label 6 for imprinting. The cylinder 23 then again causes a change in the direction of movement of the piston shaft 22 and the rack 19, and the sequence is repeated, causing the print head 44 to laterally recede from the now-imprinted label 6, execute another 180° rotation, and laterally approach the ink pad 42.

A further embodiment of a label maker constructed in accordance with the principals of the present invention is shown in FIGS. 8 through 12. Elements common to the embodiment shown in FIGS. 1 through 7 have been identified with the same reference numerals. In this embodiment, rotation of the shaft 21 and the print head 44 is caused by a rotary air actuator 70 having a base **70*a* secured to the shelf 28 by fasteners 90, such as screws (as best seen in FIG. 10). The rotary air actuator 70 has a shaft 77 extending through an opening 28*a* in the shelf 28. A rotary gear 80 having a boss 78 is co-rotatably mounted to the portion of the shaft 77 beneath the shelf 28 by means of a set screw 79. A suitable device for the rotary air actuator 70** is the "ROTAC" model S-125 1-V, manufactured by Ex-Cell-O Corporation. This device executes a rotation through 270° in each direction.

The rotary gear 80 engages a pinion gear **18*b* co-rotatably mounted on the shaft 21. The shaft 21 in this embodiment is rotatably mounted in a shaft mounting block 73 having an upper portion 74 and a lower portion 75. The upper and lower portions 74 and 75 have bearings 76 therein for permitting rotation of the shaft 21 within the block 73. Rotation of the shaft 21 is limited to 180° in each direction by a pin 81 extending radially outwardly from the shaft 21 which engages a slightly resilient damper 82 mounted beneath the lower portion 75 of the block 73. The damper 82 has a curved recess therein for receiving the pin 81 in each extreme position 81*a***.

The lower portion 75 of the block 73 has a pair of spaced rods 83 and 84 extending transversely therethrough and being rigidly held therein. Each of the rods 83 and 84 is slidably supported in bearings 85 mounted in respective spaced frame members **71*a* and 71*b*. The frame members 71*a* and 71*b* extend beneath the shelf 28 and are secured thereto by suitable fastening means 72, such as screws. Each frame member 71*a* and 71*b* additionally has mounted therein a spring element 86 having a button 87 positioned for engaging the block 73, and a nylon tip set screw 89. As can be seen in FIG. 8, each spring element 86 has a coil spring 88 therein for normally centering the block 73 between the frame members 71*a* and 71*b*. The set screws 89 can be threadably adjusted within the frame members 71*a* and 71*b* to provide a positive limitation for the lateral movement of the block 73, and thus also limiting the lateral movement of the shaft 21 and the print head 44 carried thereon. Additionally, the exterior of the spring elements 86** is threaded, so as to permit further adjustment of the lateral position of those elements.

The path followed by the print head 44 in the embodiment employing the rotary air actuator 70 is indicated in FIG. 12 and is the same as that executed by the print head 44 in the rack and pinion embodiment described above. Although the rotary air actuator 70 is stationary, the slidable mounting of the rods 83 and 84 within the frame members **71*a* and 71*b* provides sufficient play such that as the rotary gear 80 rotates and in turn rotates the pinion 18*b* connected to the shaft 21, slight lateral movement opposed by one of the spring elements 86 is also imparted to the shaft 21 and the print head 44 after the pin 81 abuts the damper 82 inhibiting further rotation of the shaft 21. The print head 44 thus moves laterally a short distance toward or away from the exposed label 6 of the stack 2, executes a 180° rotation, and executes another short lateral movement toward or away from the ink supply 40. As shown in FIG. 10, the pinion gear 18*b* assumes an extreme right position 18*c*, as viewed from above, causing the rod 84 (and the rod 83) to assume the extreme position indicated by the dashed lines 84*a* in FIG. 8. As the rotary air actuator 70 changes its direction of rotation, the pinion gear 18*b* moves through a central position 18*d* to a left extreme position 18*e*, as viewed from above, for re-inking the print head 44**.

As shown in FIG. 8, the print head 44 may be carried by the shaft 21 in other ways. For example, the top face 110 of the print head 44 may have opposed slots 111 which receive through pin 112 carried by the shaft 21. Spring urged balls 113 carried in bores 114 in the print head 44, snap over the pin 112 upon insertion of the shaft into the center bore 115 of the print head to retain the print head 44 on the shaft 21. A slot 116 on the end of shaft 21 receives pin 117 carried by the print head to assure proper orientation.

Although modifications and changes may be suggested by those skilled in the art, it is the intention of the inventors to embody within the patent warranted hereon all changes and modifications as reasonably and properly come within the scope of their contribution to the art.

We claim as our invention:

1. A label marker for use in a confined area defined at one side by an ink pad and at an opposite side by a label to be imprinted, said label marker comprising:

a print head rigidly mounted on a shaft having a longitudinal axis, said print head disposed between said label and said ink pad;

means for mounting said shaft for rotation about said longitudinal axis for limited lateral movement of said shaft substantially perpendicularly to said longitudinal axis; and means continuously engaging said shaft solely for continuously alternatingly urging rotation of said shaft in opposite directions; and means for limiting rotation of said shaft about said longitudinal axis to 180° in either direction of rotation and thereafter permitting only lateral movement of said shaft as said shaft is further urged to rotate by said means for rotating, said means for mounting, means for limiting, and means for rotating in combination sequentially moving said print head and said shaft within said confined area laterally away from said ink pad, through a first substantially 180° rotation about said longitudinal axis, laterally toward and into contact of said print head with said label for imprinting said label, laterally away from said label, through a second substantially 180° rotation about said longitudinal axis opposite to said first 180° rotation, and laterally toward and into contact of said print head with said ink pad for re-inking.

2. A label marker as claimed in claim 1 wherein said means for rotating includes a pinion connected to said shaft and a rack engaging said pinion, and a means for reciprocating said rack.

3. A label marker as claimed in claim 2 wherein said means for reciprocating said rack is a piston shaft connected to said rack and received in a pneumatic cylinder.

4. A label marker as claimed in claim 2 wherein said means for reciprocating said rack is a piston shaft connected to said rack and received in a hydraulic cylinder.

5. A label marker as claimed in claim 1 wherein said means for limiting rotation comprises:

a flap mounted on said shaft for co-rotation therewith; and a pair of stop surfaces disposed on opposite sides of said shaft in a common plane for abutting said flap and thereby stopping rotation of said shaft and said print head after 180° of rotation of said shaft and print head in opposite directions.

6. A label marker as claimed in claim 5 wherein said stop surfaces are respectively carried on a pair of blocks disposed on opposite sides of said shaft, and wherein each of said blocks has a recess for receiving said flap aligned with said stop surfaces, and wherein said combination reciprocator and rotator means slides said flap along one of said surfaces within the recess aligned with said one surface for laterally moving said print head.

7. A label marker as claimed in claim 6 further comprising a mounting block through which said shaft extends, a frame surrounding said mounting block and a pair of coil springs respectively extending between opposite sides of said mounting block and said frame parallel to the direction of lateral movement of said print head for opposing lateral movement of said mounting block thereby normally laterally centering said mounting block within said frame.

8. A label marker as claimed in claim 1 wherein said means for rotating includes a rotary air actuator having a driven rotary gear, a pinion connected to said shaft engaging said rotary gear, and wherein said means for mounting includes a mounting member rotatably supporting said shaft, and a mounting support connected to said mounting member for permitting lateral movement of said mounting member and said shaft supported therein.

9. A label marker as claimed in claim 8 wherein said means for limiting rotation comprises:

a pin radially extending from said shaft; and a pair of stop surfaces disposed on opposite sides of said shaft in a common plane for abutting said pin and thereby stopping rotation of said shaft and said print head after 180° of rotation of said shaft and print head in opposite directions.

10. A label marker as claimed in claim 8 further comprising a pair of lateral movement limiting means respectively disposed on opposite sides of said shaft for respectively stopping lateral movement of said mounting means and said shaft when said print head comes into contact with said label for imprinting said label, and for stopping lateral movement of said mounting means and said shaft when said print head comes into contact with said ink pad for re-inking.

11. A label marker as claimed in claim 10 wherein each of said lateral movement limiting means is a set screw threadably mounted in said mounting means support and disposed for abutting said mounting means during lateral movement thereof.

12. A label marker as claimed in claim 10 further comprising a pair of coil springs respectively mounted in said mounting means support on opposite sides of said mounting means and positioned for respectively engaging said mounting means during lateral movement thereof for opposing said lateral movement and thereby normally laterally centering said mounting means within said mounting means support.

13. A label marker for use in a confined area defined at one side by an ink pad and at an opposite side by a label to be imprinted, said label marker comprising:

a print head rigidly mounted on a shaft having a longitudinal axis, said print head disposed between said label and said ink pad;

a pinion connected to said shaft and a rack continuously engaging said pinion;

a means for reciprocating said rack for continuously alternatingly urging rotation of said rack in opposite directions;

means for mounting said shaft for rotation about said longitudinal axis and for limited lateral movement of said shaft substantially perpendicularly to said longitudinal axis;

a flap mounted on said shaft for co-rotation therewith; and a pair of blocks disposed on opposite sides of said shaft, each of said blocks having a stop surface thereon positioned for abutting said flap and thereby stopping rotation of said shaft and said print head after 180° of rotation of said shaft and print head in opposite directions, said flap sliding along said stop surface after abutment therewith as said rack reciprocate and continues to urge rotation of said shaft thereby imparting lateral movement to said shaft and print head, whereby each complete reciprocation of said rack sequentially moves said print head and said shaft within said confined area laterally away from said ink pad, through a first substantially 180° rotation about said longitudinal axis, laterally toward and into contact of said print head with said label for imprinting said label, laterally away from said label, through a second substantially 180° rotation about said longitudinal axis opposite to said first 180° rotation, and laterally toward and into contact of said print head with said ink pad for re-inking.

14. A label marker as claimed in claim 13 wherein each of said blocks further has a recess, said recess being co-planar and said flap sliding laterally within one of said recesses during lateral movement of said print head.

15. A label marker as claimed in claim 14 further comprising a mounting block through which said shaft extends, a frame surrounding said mounting block and a pair of coil springs respectively extending between opposite sides of said mounting block and said frame parallel to the direction of lateral movement of said print head for opposing lateral movement of said mounting block thereby normally laterally centering said mounting block within said frame.

16. A label marker for use in a confined area defined at one side by an ink pad and at an opposite side by a label to be imprinted, said label marker comprising:

a print head rigidly mounted on a shaft having a longitudinal axis, said print head disposed between said label and said ink pad;

a rotary air actuator having a driven rotary gear;

a pinion connected to said shaft continuously engaging said rotary gear for continuously urging rotation of said shaft and said print head;

a mounting means supporting said shaft for rotation about said longitudinal axis;

a mounting means support connected to said mounting means for permitting limited lateral movement of said mounting means and said shaft supported therein;

a pin radially extending from said shaft; and a pair of stop surfaces disposed on opposite sides of said shaft in a common plane for abutting said pin and thereby stopping rotation of said shaft and said print head after 180° of rotation of said shaft and print head in opposite directions, said pin sliding along one of said stop surfaces after abutment therewith thereby imparting lateral movement to said shaft and print head as said pinion continues to urge said shaft to rotate, whereby for each complete actuation of said rotary air actuator, said print head and said shaft are sequentially moved thereby within said confined area laterally away from said ink pad, through a first substantially 180° rotation about said longitudinal axis, laterally toward and into contact of said print head with said label for imprinting said label, laterally away from said label, through a second substantially 180° rotation about said longitudinal axis opposite to said first 180° rotation, and laterally toward and into contact of said print head with said ink pad for re-inking.

17. A label marker as claimed in claim 16 further comprising a pair of set screws threadably mounted in said mounting means support on opposite sides of said mounting means and positioned for abutting said mounting means during lateral movement thereof.

18. A label marker as claimed in claim 17 further comprising a pair of coil springs respectively mounted in said mounting means support on opposite sides of said mounting means for opposing lateral movement of said mounting means thereby laterally centering said mounting means within said mounting means support.

* * * * *